US010004942B1

(12) United States Patent
Huang

(10) Patent No.: US 10,004,942 B1
(45) Date of Patent: Jun. 26, 2018

(54) WHEEL EXERCISING DEVICE

(71) Applicant: JSS Sports Co., Ltd., Chang-Hwa Hsien (TW)

(72) Inventor: Chin-Chen Huang, Fuxing Township (TW)

(73) Assignee: JSS Sports Co., Ltd., Chang-Hwa Hsien (TW)

( * ) Notice: Subject to any disclaimer, the term of this patent is extended or adjusted under 35 U.S.C. 154(b) by 0 days. days.

(21) Appl. No.: 15/430,585

(22) Filed: Feb. 13, 2017

(51) Int. Cl.

| | |
|---|---|
| ***A63B 21/02*** | (2006.01) |
| ***A63B 22/20*** | (2006.01) |
| ***A63B 21/055*** | (2006.01) |
| ***A63B 21/00*** | (2006.01) |
| ***A63B 23/12*** | (2006.01) |

(52) U.S. Cl.
CPC ..... *A63B 22/20* (2013.01); *A63B 21/0552* (2013.01); *A63B 21/4035* (2015.10); *A63B 21/4043* (2015.10); *A63B 23/12* (2013.01)

(58) Field of Classification Search
CPC . A63B 21/0004; A63B 23/1236; A63B 21/05; A63B 21/40; A63B 22/20
USPC ..... 482/13, 51, 66, 68, 92, 120–131, 132, 482/141
See application file for complete search history.

(56) References Cited

U.S. PATENT DOCUMENTS 285,476 A * 9/1883 Frink ..... F28F 5/02 165/89
1,247,162 A * 11/1917 Southwick ..... A21C 3/021 492/14
2,920,418 A * 1/1960 Britt ..... A63B 21/0004 446/241
3,831,238 A * 8/1974 Adams ..... A21C 3/021 492/14
3,938,803 A * 2/1976 Wilmoth ..... A63B 21/05 482/127
4,314,395 A * 2/1982 Brock ..... B44C 7/06 15/230.11
4,639,961 A * 2/1987 Chasan ..... A47C 27/085 5/673
4,862,542 A * 9/1989 Jordan ..... A47C 21/00 5/673
5,000,671 A * 3/1991 Nolte ..... B28B 3/12 134/68
5,152,731 A * 10/1992 Troutman ..... A63B 21/0724 482/106

(Continued)

*Primary Examiner* — Garrett Atkinson
(74) *Attorney, Agent, or Firm* — Alan D. Kamrath; Kamrath IP Lawfirm, P.A.

(57) ABSTRACT

A wheel exercising device includes a shank, at least one wheel mounted on the shank, two handgrips mounted on the shank, two mounting rings mounted on the shank, and two caps mounted on the shank and resting on the mounting rings. The shank has a first threaded section and a second threaded section having opposite screwing directions. Each of the handgrips is formed with an internal threaded section screwed onto the first threaded section and the second threaded section. Each of the handgrips is formed with a connecting ring, and at least one elastic member is connected between the connecting ring of each of the handgrips and each of the mounting rings. In practice, when the wheel is rotated forward and backward, the handgrips are moved inward and outward synchronously along the first threaded section and the second threaded section.

11 Claims, 15 Drawing Sheets

(56) References Cited

U.S. PATENT DOCUMENTS 5,261,866 A * 11/1993 Mattox ..... A63B 21/0552 482/125
5,334,118 A * 8/1994 Dantolan ..... A63B 15/005 482/109
5,499,961 A * 3/1996 Mattox ..... A63B 21/055 482/123
6,280,369 B1 * 8/2001 Gibran ..... A21C 3/021 492/14
6,638,201 B1 * 10/2003 Dischler ..... A63B 22/20 482/132
7,175,573 B1 * 2/2007 Huang ..... A63B 21/0004 446/236
7,175,575 B1 * 2/2007 Dantolen ..... A63B 15/005 482/121
7,322,905 B2 * 1/2008 Morris ..... A63B 23/047 482/118
7,387,599 B1 * 6/2008 Hsu ..... A61H 15/0092 482/122
7,404,228 B2 * 7/2008 Hodges ..... B05C 17/0217 15/230.11
8,137,251 B2 * 3/2012 Tozzi ..... A63B 22/203 482/132
D688,337 S * 8/2013 Huang ..... D21/662
8,550,965 B2 * 10/2013 Candela ..... A63B 23/0211 482/132
8,894,555 B2 * 11/2014 Colledge ..... A63B 21/0004 482/118
D794,725 S * 8/2017 Lamothe ..... D21/679
9,808,665 B1 * 11/2017 Demarais ..... A63B 21/4035
2002/0111256 A1 * 8/2002 Tuller ..... A63B 21/026 482/140
2003/0050153 A1 * 3/2003 Stevens ..... A63B 21/025 482/92
2003/0134726 A1 * 7/2003 Yu ..... A63B 21/00043 482/110
2003/0158023 A1 * 8/2003 Yu ..... A63B 21/0004 482/126
2004/0040111 A1 * 3/2004 Er ..... B05C 17/0217 15/230.11
2005/0202944 A1 * 9/2005 Deal ..... A61H 15/0092 482/126
2008/0167168 A1 * 7/2008 Hurst ..... A63B 21/0728 482/132
2009/0064436 A1 * 3/2009 Scott, Sr. ..... B05C 17/0217 15/230.11
2011/0160024 A1 * 6/2011 Candela ..... A63B 23/0211 482/132
2012/0100969 A1 * 4/2012 Brodbeck ..... A63B 22/20 482/132
2013/0095984 A1 * 4/2013 Agate ..... A63B 21/0618 482/106

* cited by examiner

WHEEL EXERCISING DEVICE

BACKGROUND OF THE INVENTION

1. Field of the Invention

The present invention relates to a small-size exercising device and, more particularly, to a wheel exercising device.

2. Description of the Related Art

A conventional wheel exercising device 40 in accordance with the prior art shown in FIG. 15 comprises a shank 41 and two wheels 42 each mounted on the shank 41 by a screw cover 43. The shank 41 is formed with two rough surfaces 44 to facilitate the user holding the shank 41. When in use, the user's two feet are placed on the ground, and the user's two hands hold and apply a force on the shank 41 to move and rotate the two wheels 42 on the ground. In such a manner, the user has to apply a large force to move and rotate the two wheels 42 forward and backward, so as to exercise the user's body. However, the distance between the two rough surfaces 44 of the shank 41 is fixed so that the user's two arms are kept a constant width and cannot move sideward, thereby decreasing the variation and amusement of the exercising process, and decreasing the exercising strength. In addition, the two wheels 42 are rotated relative to the shank 41, and the clearance between each of the two wheels 42 and the shank 41 has to be controlled exactly, so that the screw covers 43 cannot be disassembled under the normal condition, and are needed to be detached from the two wheels 42 only under a necessary condition. Further, it is difficult to detach the screw covers 43 from the two wheels 42, thereby greatly causing inconvenience to the user when disassembling the conventional wheel exercising device 40.

BRIEF SUMMARY OF THE INVENTION

The primary objective of the present invention is to provide a wheel exercising device that has an enhanced exercising effect, and is assembled and disassembled easily and quickly.

In accordance with the present invention, there is provided a wheel exercising device comprising a shank, at least one wheel mounted on the shank, two handgrips mounted on the shank, two mounting rings mounted on the shank, and two caps mounted on the shank and resting on and limiting the two mounting rings respectively. The shank has a surface formed with a first threaded section and a second threaded section having opposite screwing directions. The shank is provided with a shaft portion located between the first threaded section and the second threaded section. The shank has two ends each provided with a connecting portion. Each of the two mounting rings is mounted on the respective connecting portion of the shank. Each of the two caps is mounted on the respective connecting portion of the shank. The at least one wheel has a center provided with a shaft hole secured on the shaft portion of the shank. Each of the two handgrips is formed with a through hole, and the through holes of the two handgrips are mounted on the first threaded section and the second threaded section of the shank. The through hole of each of the two handgrips has a peripheral wall formed with an internal threaded section, and the internal threaded sections of the two handgrips are screwed onto the first threaded section and the second threaded section of the shank. Each of the two handgrips is formed with a connecting ring directed toward one of the two caps, and at least one elastic member is connected between the connecting ring of each of the two handgrips and each of the two mounting rings. In practice, when the at least one wheel is rotated forward and backward, the two handgrips are moved inward and outward synchronously along the first threaded section and the second threaded section of the shank, and the at least one elastic member provides a pulling force between the connecting ring of each of the two handgrips and each of the two mounting rings, to pull the two handgrips toward the two mounting rings respectively.

According to the primary advantage of the present invention, when the at least one wheel is rotated forward and backward, the two handgrips displace sideward on the shank to successively change the distance between the two handgrips, so that the user's two arms are moved rightward and leftward reciprocally, so as to exercise the user's two arms, thereby achieving variation and amusement of the wheel exercising device during the exercising process, and thereby exercising more part of the user's body, so as to enhance the exercising effect.

According to another advantage of the present invention, the at least one elastic member provides a restoring force to each of the two handgrips so that the user operates the two handgrips in an energy-saving manner.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
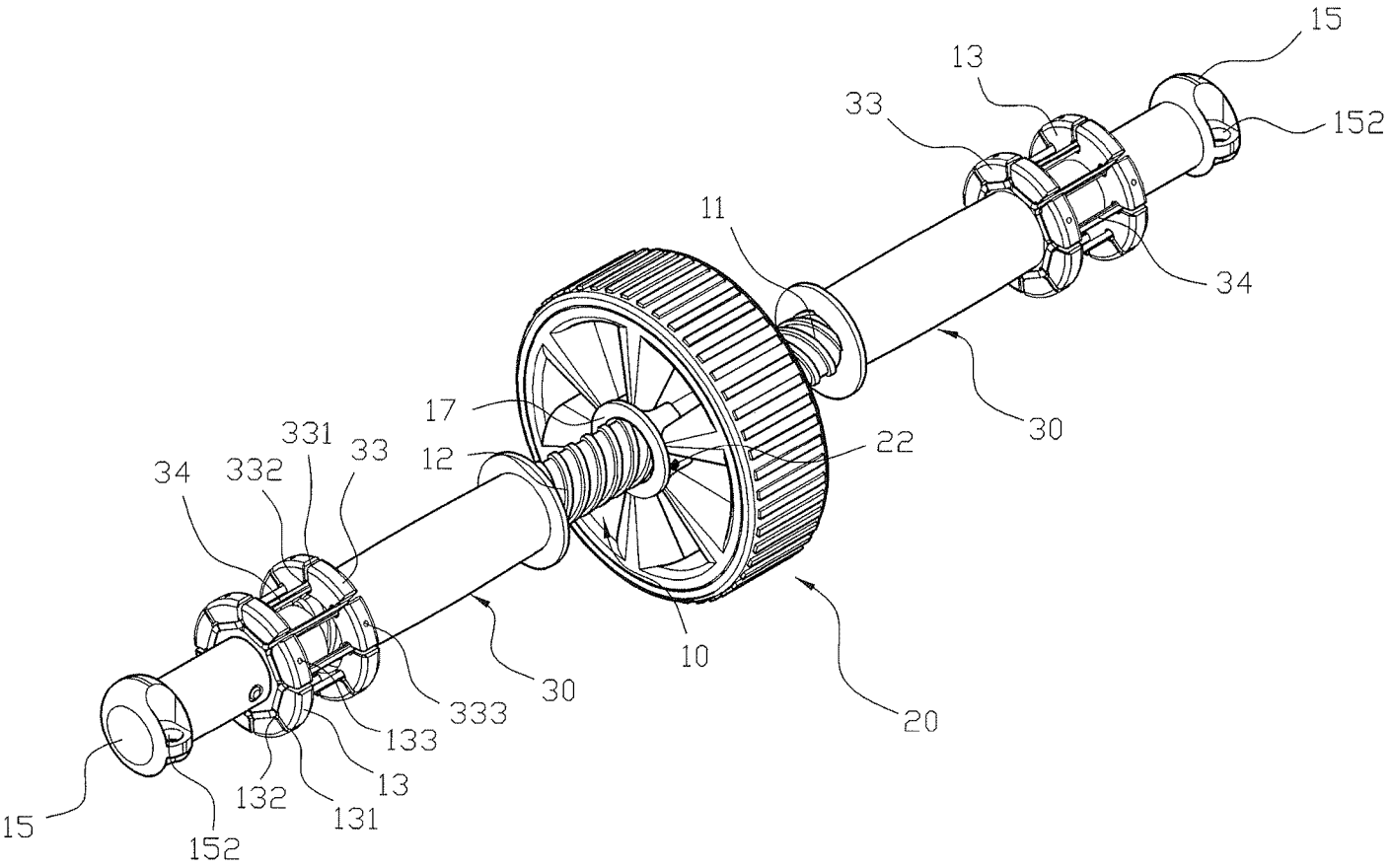
FIG. 1 is a perspective view of a wheel exercising device in accordance with the first preferred embodiment of the present invention.
Figure 2:
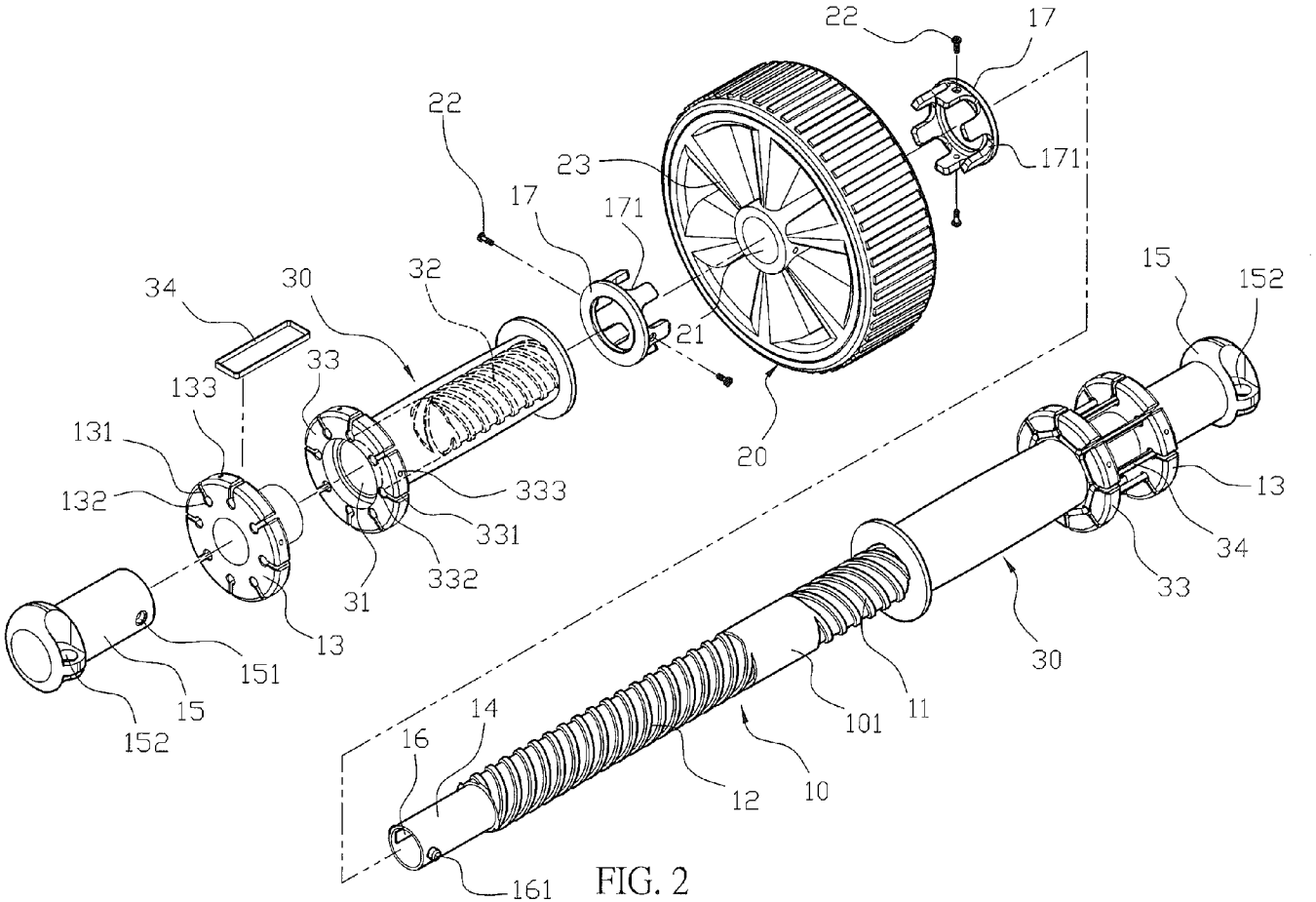
FIG. 2 is an exploded perspective view of the wheel exercising device as shown in FIG. 1.
Figure 3:
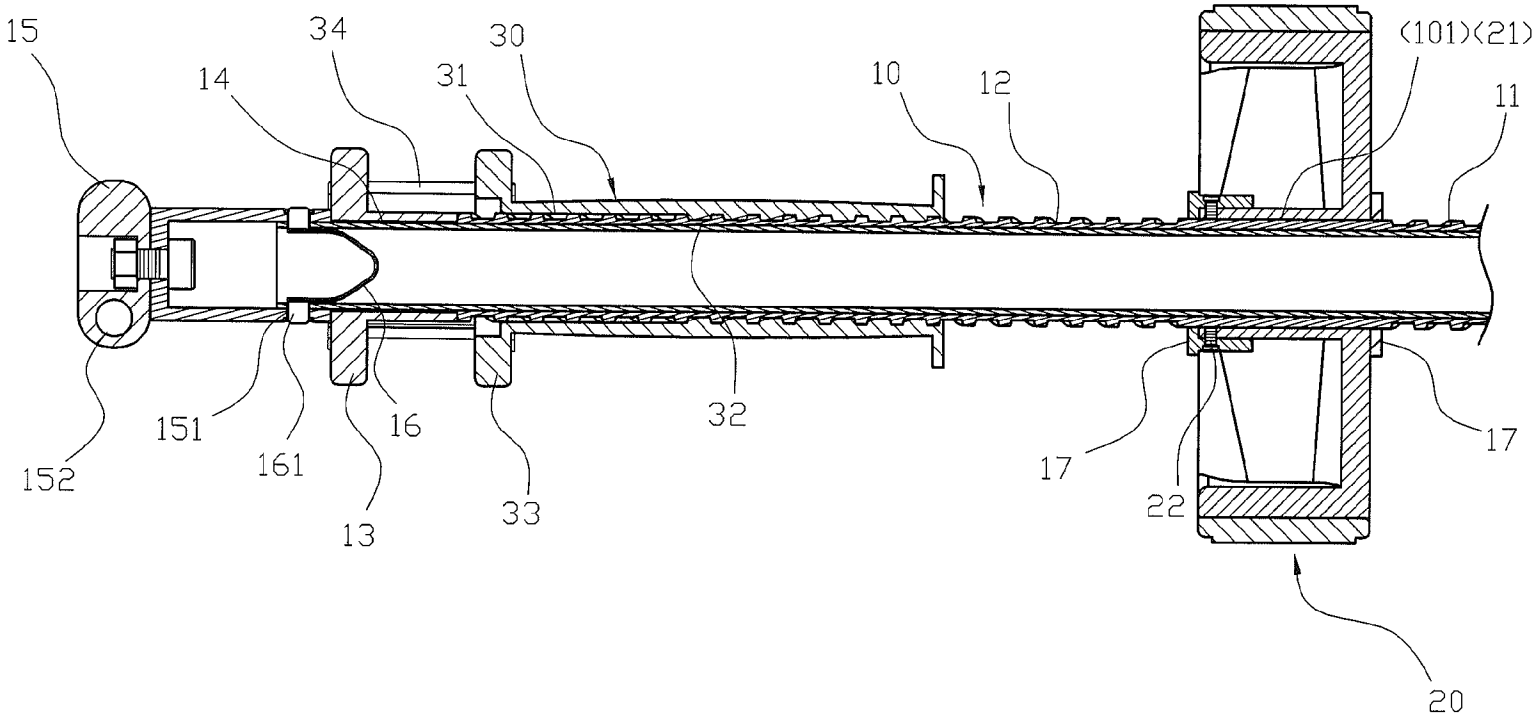
FIG. 3 is a partially cross-sectional view of the wheel exercising device as shown in FIG. 1.
Figure 4:
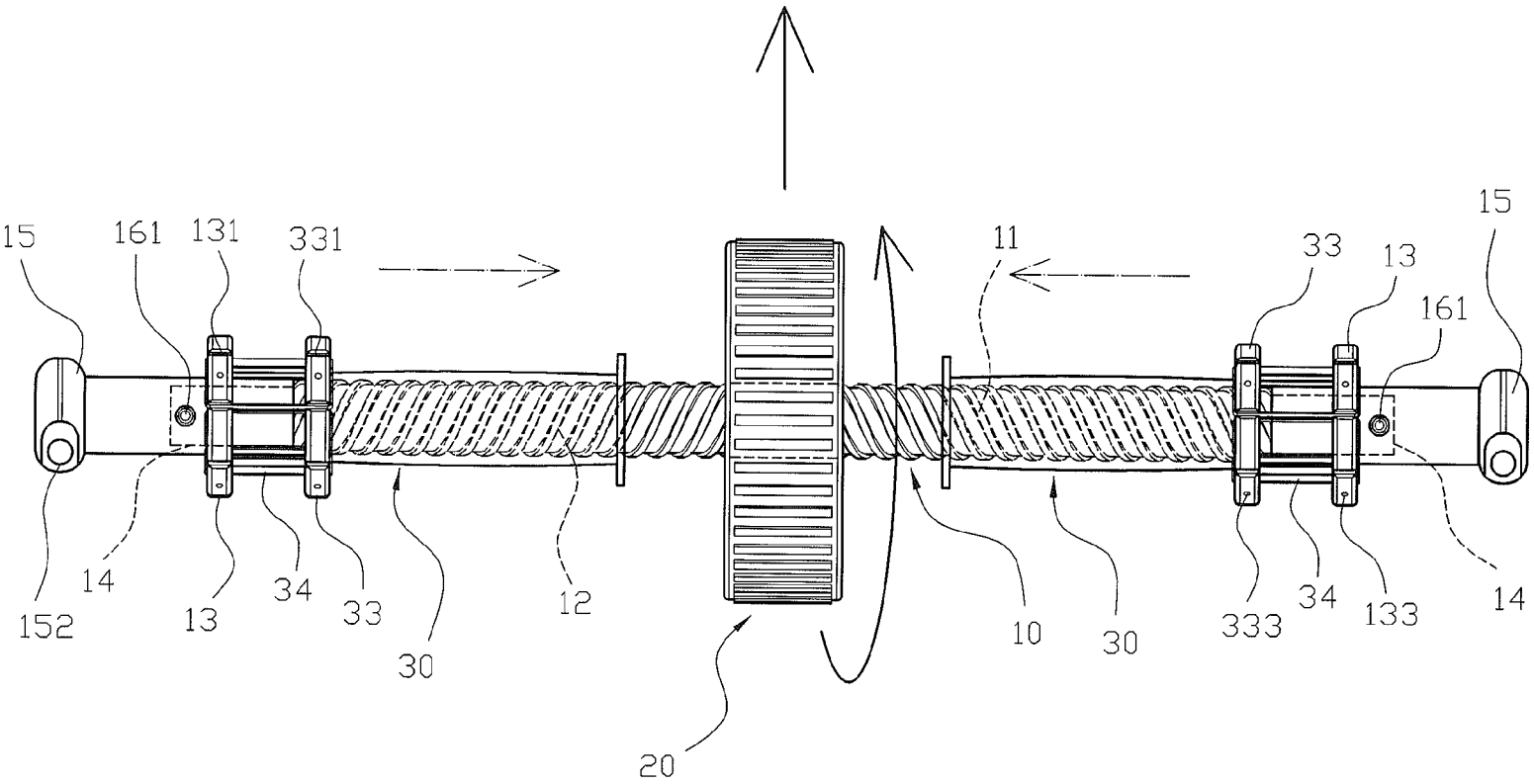
FIG. 4 is a first schematic operational view of the wheel exercising device as shown in FIG. 1 in use.
Figure 5:
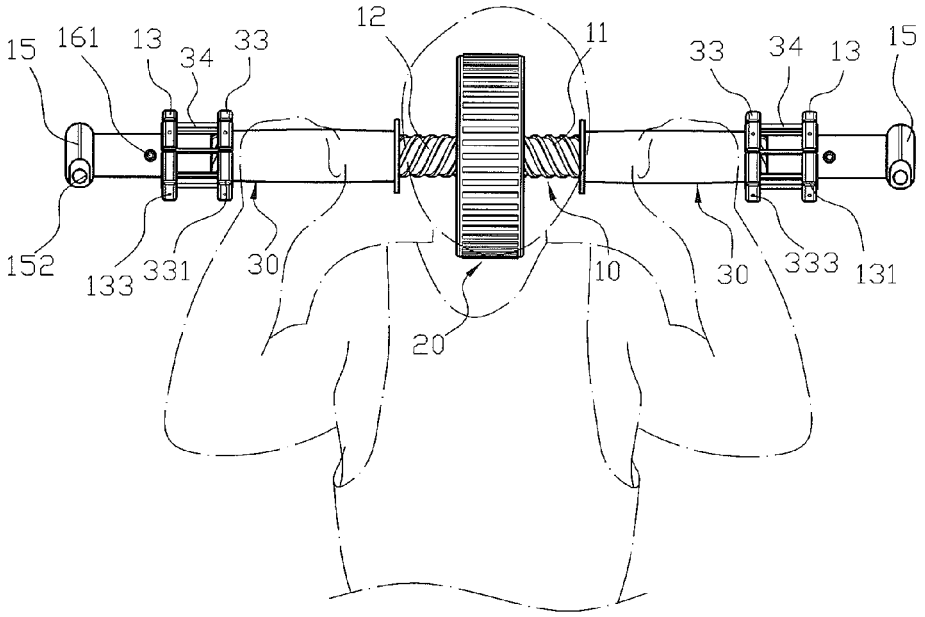
FIG. 5 is a second schematic operational view of the wheel exercising device as shown in FIG. 1 in use.
Figure 6:
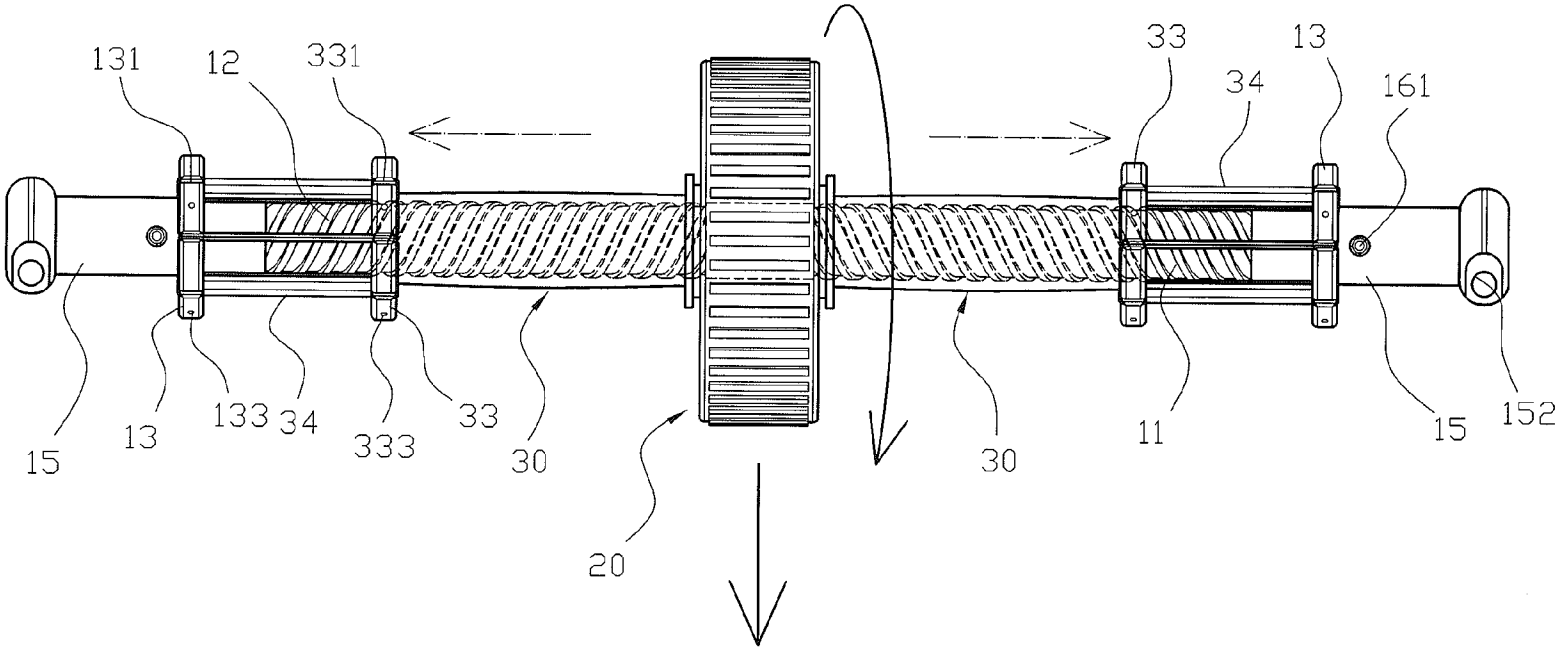
FIG. 6 is a third schematic operational view of the wheel exercising device as shown in FIG. 1 in use.
Figure 7:
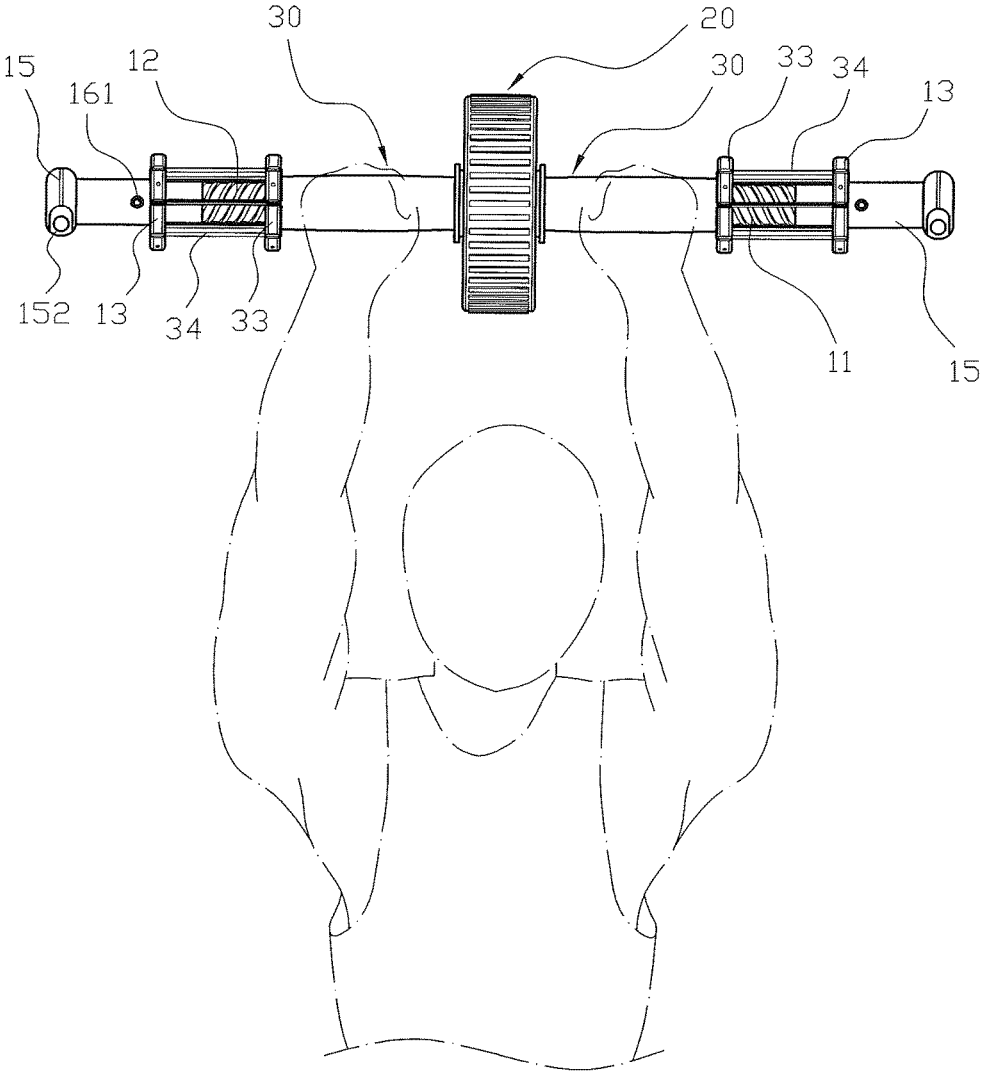
FIG. 7 is a fourth schematic operational view of the wheel exercising device as shown in FIG. 1 in use.

Referring to the drawings and initially to FIGS. 1-3, a wheel exercising device in accordance with the preferred embodiment of the present invention comprises a shank 10, at least one wheel 20 mounted on the shank 10, two handgrips 30 mounted on the shank 10, two mounting rings 13 mounted on the shank 10, and two caps 15 mounted on the shank 10 and resting on and limiting the two mounting rings 13 respectively.

The shank 10 has a surface formed with a first threaded section 11 and a second threaded section 12 having opposite screwing directions. The first threaded section 11 and the second threaded section 12 of the shank 10 are arranged symmetrically. The shank 10 is provided with a shaft portion 101 located between the first threaded section 11 and the second threaded section 12. Preferably, the shaft portion 101 of the shank 10 is located at the middle position of the shank 10. The shank 10 has two ends each provided with a connecting portion 14 juxtaposed to the first threaded section 11 and the second threaded section 12.

Each of the two mounting rings 13 is mounted on the respective connecting portion 14 of the shank 10. Each of the two caps 15 is mounted on the respective connecting portion 14 of the shank 10. The at least one wheel 20 has a center provided with a shaft hole 21 secured on the shaft portion 101 of the shank 10.

Each of the two handgrips 30 is formed with a through hole 31, and the through holes 31 of the two handgrips 30 are mounted on the first threaded section 11 and the second threaded section 12 of the shank 10. The through hole 31 of each of the two handgrips 30 has a peripheral wall formed with an internal threaded section 32, and the internal threaded sections 32 of the two handgrips 30 are screwed onto the first threaded section 11 and the second threaded section 12 of the shank 10. Each of the two handgrips 30 is formed with a connecting ring 33 directed toward one of the two caps 15, and at least one elastic member 34 is connected between the connecting ring 33 of each of the two handgrips 30 and each of the two mounting rings 13.

In practice, when the at least one wheel 20 is rotated forward and backward, the two handgrips 30 are moved inward and outward synchronously along the first threaded section 11 and the second threaded section 12 of the shank 10, and the at least one elastic member 34 provides a pulling force between the connecting ring 33 of each of the two handgrips 30 and each of the two mounting rings 13, to pull the two handgrips 30 toward the two mounting rings 13 respectively, so as to enhance the exercising effect of wheel movement.

In the preferred embodiment of the present invention, each of the two caps 15 is provided with two apertures 151, and the respective connecting portion 14 of the shank 10 has an interior provided with a substantially U-shaped elastic plate 16 which has two ends each provided with a boss 161 which protrudes from the respective connecting portion 14 and is inserted into each of the two apertures 151 to form a quick release structure between each of the two caps 15 and the shank 10.

In the preferred embodiment of the present invention, the at least one wheel 20 is locked on the shaft portion 101 of the shank 10 by a plurality of bolts 22.

In the preferred embodiment of the present invention, the at least one wheel 20 is formed with a plurality of spokes 23 extending outward from the shaft hole 21 in a radiating manner. The wheel exercising device further comprises two limit members 17 mounted on the shank 10 and abutting the at least one wheel 20. Each of the two limit members 17 is formed with a plurality of retaining grooves 171 directed toward and mounted on the spokes 23 of the at least one wheel 20. The bolts 22 extend through each of the two limit members 17 and the at least one wheel 20 and press the shaft portion 101 of the shank 10, so that the at least one wheel 20 is secured on the shank 10.

In the preferred embodiment of the present invention, the connecting ring 33 of each of the two handgrips 30 is formed with a plurality of slits 331 arranged in a radiating manner. Each of the slits 331 of each of the two handgrips 30 allows entrance of the at least one elastic member 34 and has a bottom formed with a positioning hole 332 for limiting the at least one elastic member 34. Each of the two mounting rings 13 is formed with a plurality of slits 131 arranged in a radiating manner. Each of the slits 131 of each of the two mounting rings 13 allows entrance of the at least one elastic member 34 and has a bottom formed with a positioning hole 132 for limiting the at least one elastic member 34.

In the preferred embodiment of the present invention, the at least one elastic member 34 is an elastic loop made of rubber and extending through two adjacent positioning holes 332 of each of the two handgrips 30 and two adjacent positioning holes 132 of each of the two mounting rings 13.

In assembly, the shaft hole 21 of the at least one wheel 20 is mounted on the shaft portion 101 of the shank 10. Then, the two limit members 17 are mounted on the shank 10, and the retaining grooves 171 of each of the two limit members 17 are locked on the spokes 23 of the at least one wheel 20. Then, the bolts 22 extend through each of the two limit members 17 and the at least one wheel 20 and press the shaft portion 101 of the shank 10, so that the at least one wheel 20 is secured on the shank 10 solidly. Thus, the at least one wheel 20 is operated stably. Then, the through holes 31 of the two handgrips 30 are mounted on the shank 10, and the internal threaded sections 32 of the two handgrips 30 are screwed onto the first threaded section 11 and the second threaded section 12 of the shank 10. At this time, the connecting ring 33 of each of the two handgrips 30 is directed toward the respective connecting portion 14 of the shank 10. Then, each of the two mounting rings 13 is mounted on the respective connecting portion 14 of the shank 10. Then, the at least one elastic member 34 is mounted between the connecting ring 33 of each of the two handgrips 30 and each of the two mounting rings 13. At this time, the at least one elastic member 34 extends through the slits 131 of each of the two mounting rings 13 into and positioned in the positioning holes 132. Similarly, the at least one elastic member 34 also extends through the slits 331 of each of the two handgrips 30 into and positioned in the positioning holes 332. In such a manner, each of the two handgrips 30 is pulled by the at least one elastic member 34 and is located adjacent to the respective connecting portion 14 of the shank 10. Then, each of the two caps 15 is mounted on the respective connecting portion 14 of the shank 10, and the respective boss 161 of the U-shaped elastic plate 16 is inserted into and locked in each of the two apertures 151 of each of the two caps 15. In such a manner, each of the two mounting rings 13 is stopped by each of the two caps 15, and is secured on the respective connecting portion 14 of the shank 10. At this time, each of the two handgrips 30 is limited to move between the at least one wheel 20 and each of the two mounting rings 13.

On the contrary, when the respective boss 161 of the U-shaped elastic plate 16 is pressed inward and retracted from each of the two apertures 151 of each of the two caps 15, each of the two caps 15 is released from the respective connecting portion 14 of the shank 10, so that each of the two caps 15 can be removed from the shank 10. Then, the at least one elastic member 34 is detached from the connecting ring 33 of each of the two handgrips 30 and each of the two mounting rings 13. Then, each of the two mounting rings 13 is removed from the shank 10. Then, each of the two handgrips 30 is removed from the shank 10. Then, the bolts 22 are unscrewed to release the at least one wheel 20 from the shaft portion 101 of the shank 10, so that the at least one wheel 20 can be removed from the shank 10. Thus, the wheel exercising device is assembled and disassembled easily and quickly. In addition, the wheel exercising device is carried and stored easily and conveniently.

In operation, referring to FIGS. 4-7 with reference to FIGS. 1-3, the user's two feet are placed on the ground, and the user's two hands hold and apply a force on the at least one wheel 20 to drive and move the at least one wheel 20 on the ground. In such a manner, the user has to apply a determined force to move the at least one wheel 20 forward and backward, so as to exercise the user's body. At this time, when the at least one wheel 20 is rotated forward and backward, the two handgrips 30 are held by the user's two hands, so that the two handgrips 30 are not rotated synchronously with the at least one wheel 20. In addition, the internal threaded sections 32 of the two handgrips 30 are screwed onto the first threaded section 11 and the second threaded section 12 of the shank 10. Thus, when the at least one wheel 20 is rotated backward, the two handgrips 30 are moved on the first threaded section 11 and the second threaded section 12 of the shank 10, and are moved outward toward the two caps 15, while the at least one elastic member 34 is retracted elastically. On the contrary, when the at least one wheel 20 is rotated forward, the two handgrips 30 are moved on the first threaded section 11 and the second threaded section 12 of the shank 10, and are moved inward toward the at least one wheel 20, while the at least one elastic member 34 is extended by the two handgrips 30.

Accordingly, when the at least one wheel 20 is rotated forward and backward, the two handgrips 30 displace sideward on the shank 10 to successively change the distance between the two handgrips 30, so that the user's two arms are moved rightward and leftward reciprocally, so as to exercise the user's two arms, thereby achieving variation and amusement of the wheel exercising device during the exercising process, and thereby exercising more part of the user's body, so as to enhance the exercising effect. In addition, the at least one elastic member 34 provides a restoring force to each of the two handgrips 30 so that the user operates the two handgrips 30 in an energy-saving manner. Further, each of the two caps 15 is mounted on or detached from the shank 10 by operation of the U-shaped elastic plate 16, so that the wheel exercising device is assembled and disassembled easily, quickly and conveniently.

Figure 8:
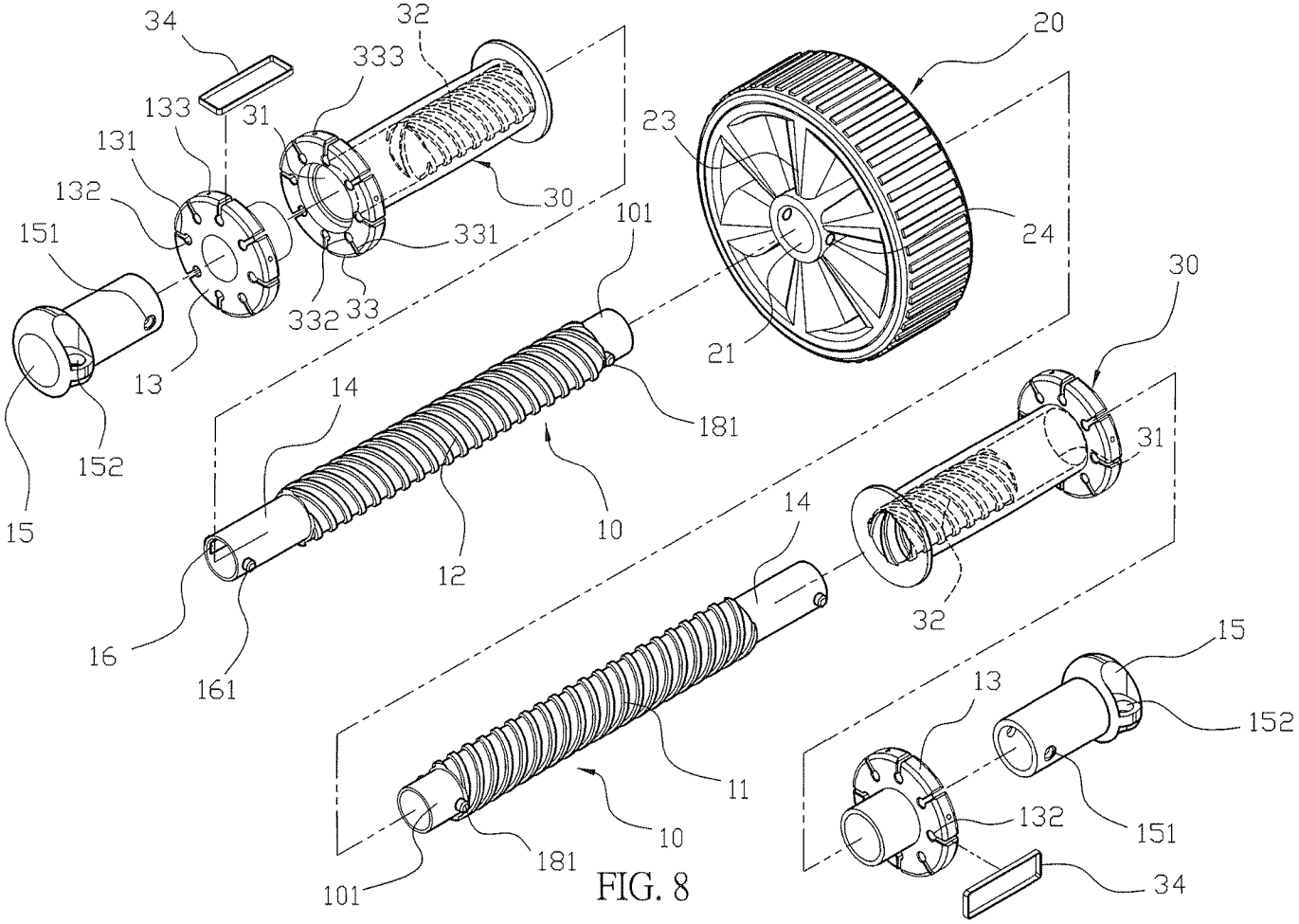
FIG. 8 is an exploded perspective view of a wheel exercising device in accordance with the second preferred embodiment of the present invention.
Figure 9:
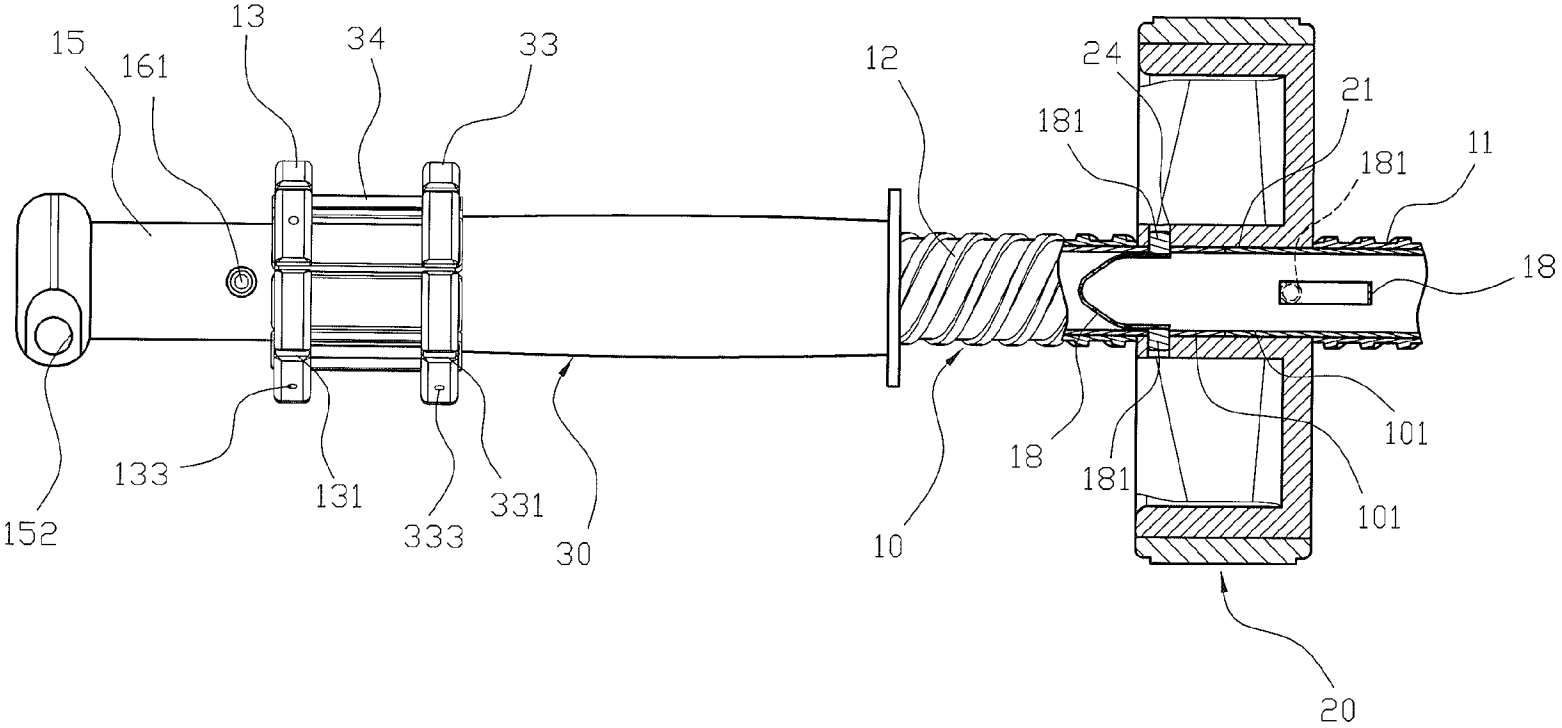
FIG. 9 is a partially cross-sectional assembly view of the wheel exercising device as shown in FIG. 8.

Referring to FIGS. 8 and 9, the shaft portion 101 of the shank 10 is divided into two parts, and the wheel exercising device comprises two shanks 10 each having a shaft portion 101. The at least one wheel 20 has two ends each formed with two retaining holes 24 connected to the shaft hole 21. The shaft portion 101 of each of the two shanks 10 has an interior provided with a substantially U-shaped elastic plate 18 which has two ends each provided with a boss 181 which protrudes from the shaft portion 101 of each of the two shanks 10 and is inserted into each of the two retaining holes 24 of the at least one wheel 20 to form a quick release structure between the at least one wheel 20 and each of the two shanks 10. Thus, the length of each of the two shanks 10 is shortened to facilitate carrying and storage of the two shanks 10.

Figure 10:
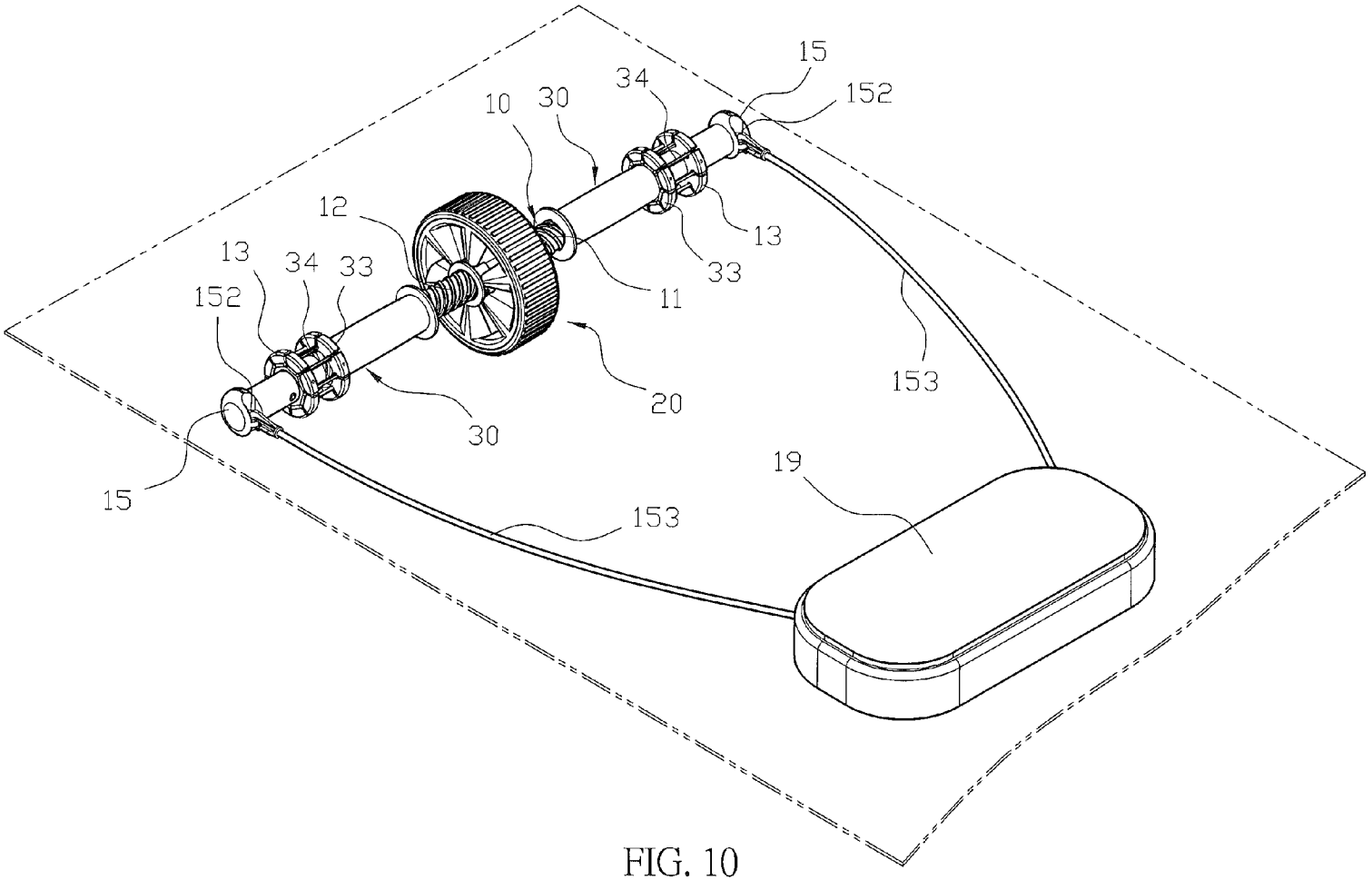
FIG. 10 is a perspective view of a wheel exercising device in accordance with the third preferred embodiment of the present invention.

Referring to FIG. 10 with reference to FIG. 2, each of the two caps 15 is provided with a connecting hole 152, and the wheel exercising device further comprises a cushion 19 and two elastic cords 153 each having a first end connected with the connecting hole 152 of each of the two caps 15 and a second end connected with the cushion 19. In such a manner, when the at least one wheel 20 is rotated forward, the two elastic cords 153 are extended, and when the at least one wheel 20 is rotated backward, the two elastic cords 153 provide a restoring force, thereby achieving another exercising purpose.

Figure 11:
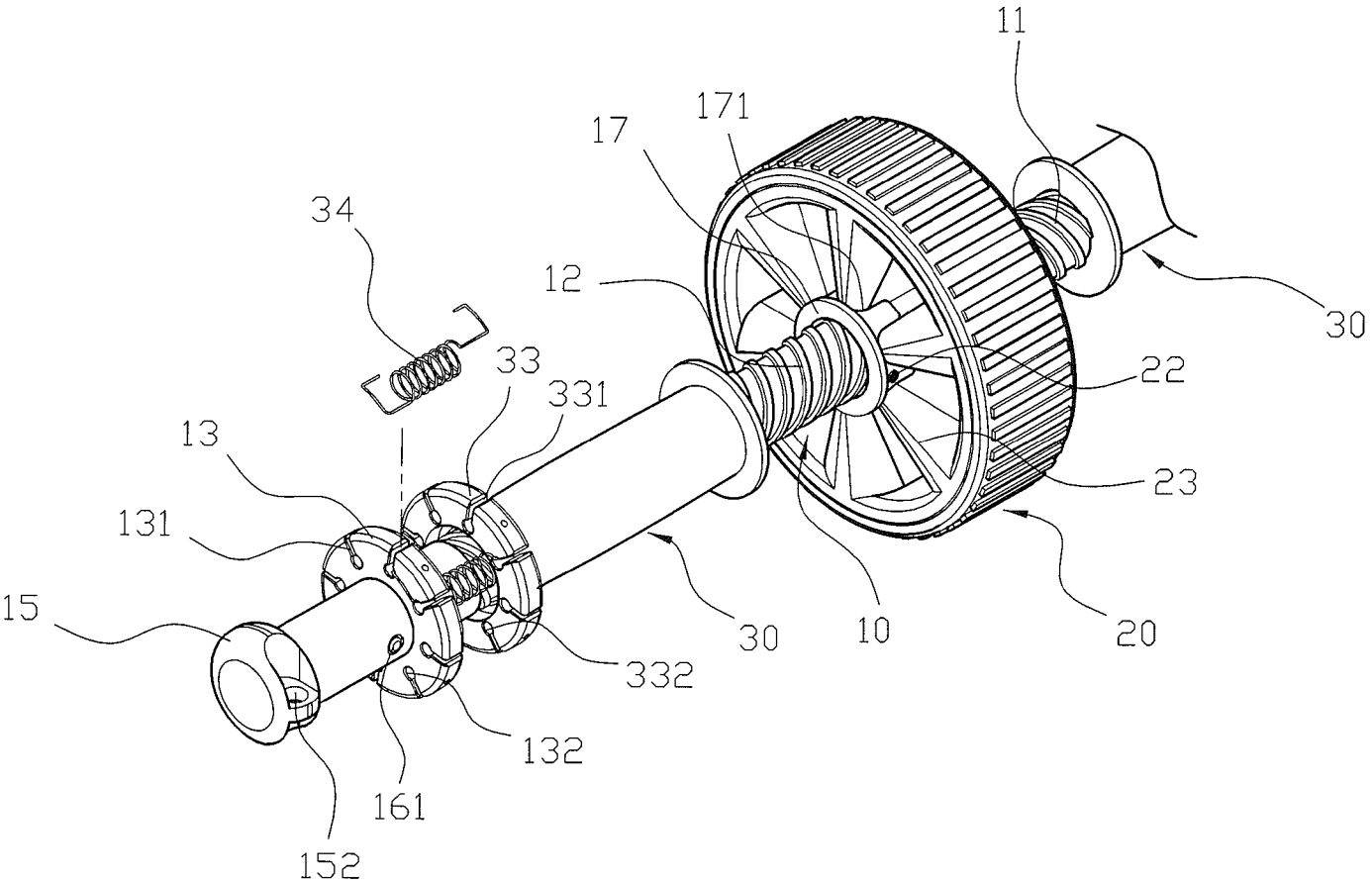
FIG. 11 is a partially exploded perspective view of a wheel exercising device in accordance with the fourth preferred embodiment of the present invention.

Referring to FIG. 11, the at least one elastic member 34 is a tension spring hooked between the respective positioning hole 132 of each of the two mounting rings 13 and the respective positioning hole 332 of each of the two handgrips 30.

Figure 12:
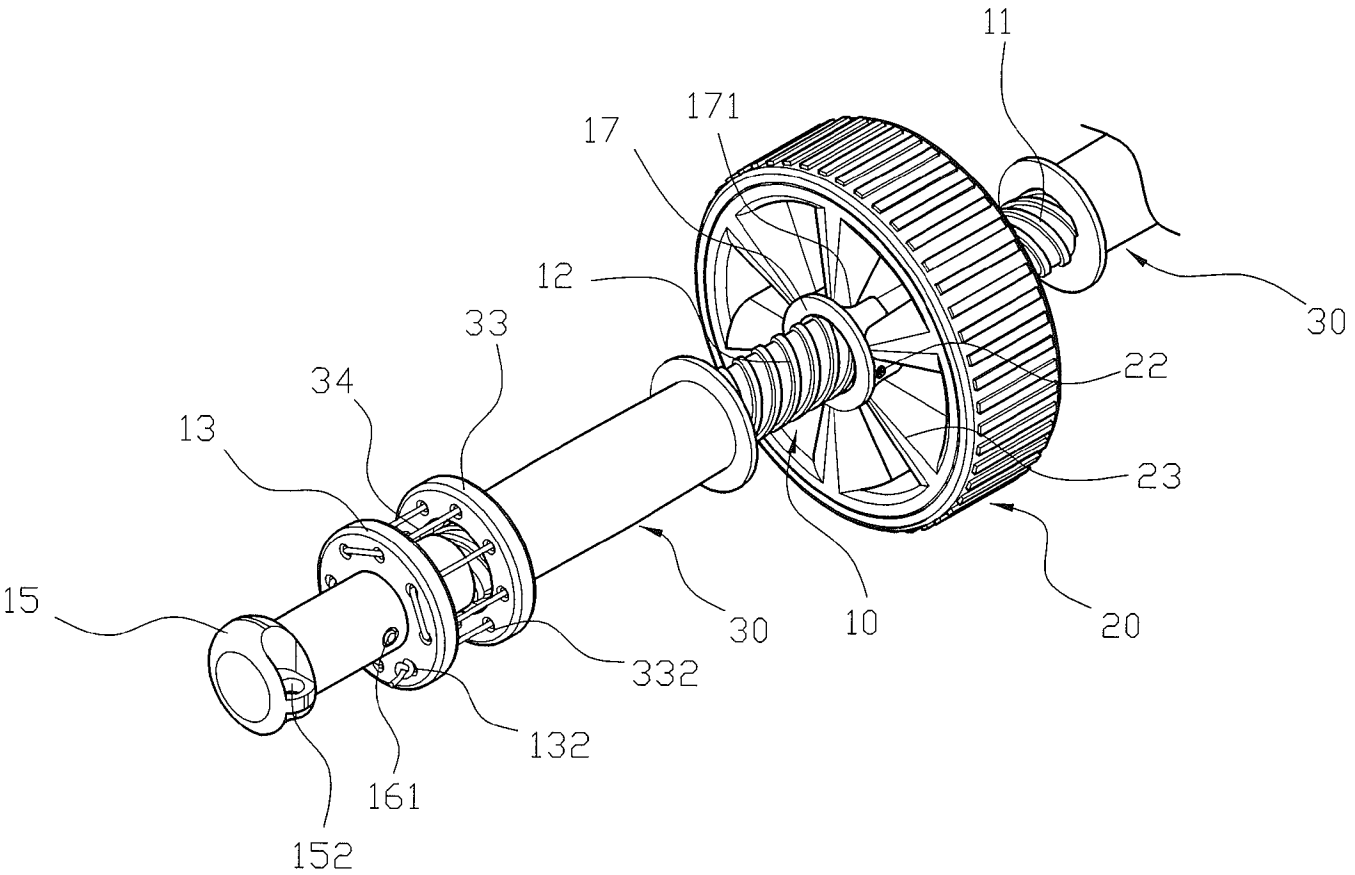
FIG. 12 is a partially perspective view of a wheel exercising device in accordance with the fifth preferred embodiment of the present invention.

Referring to FIG. 12, each of the two mounting rings 13 is directly formed with a plurality of positioning holes 132 for fixing the at least one elastic member 34, and the connecting ring 33 of each of the two handgrips 30 is directly formed with a plurality of positioning holes 332 for fixing the at least one elastic member 34. The at least one elastic member 34 is an elastic cord extending through all of the positioning holes 132 of each of the two mounting rings 13 and all of the positioning holes 332 of each of the two handgrips 30.

Figure 13:
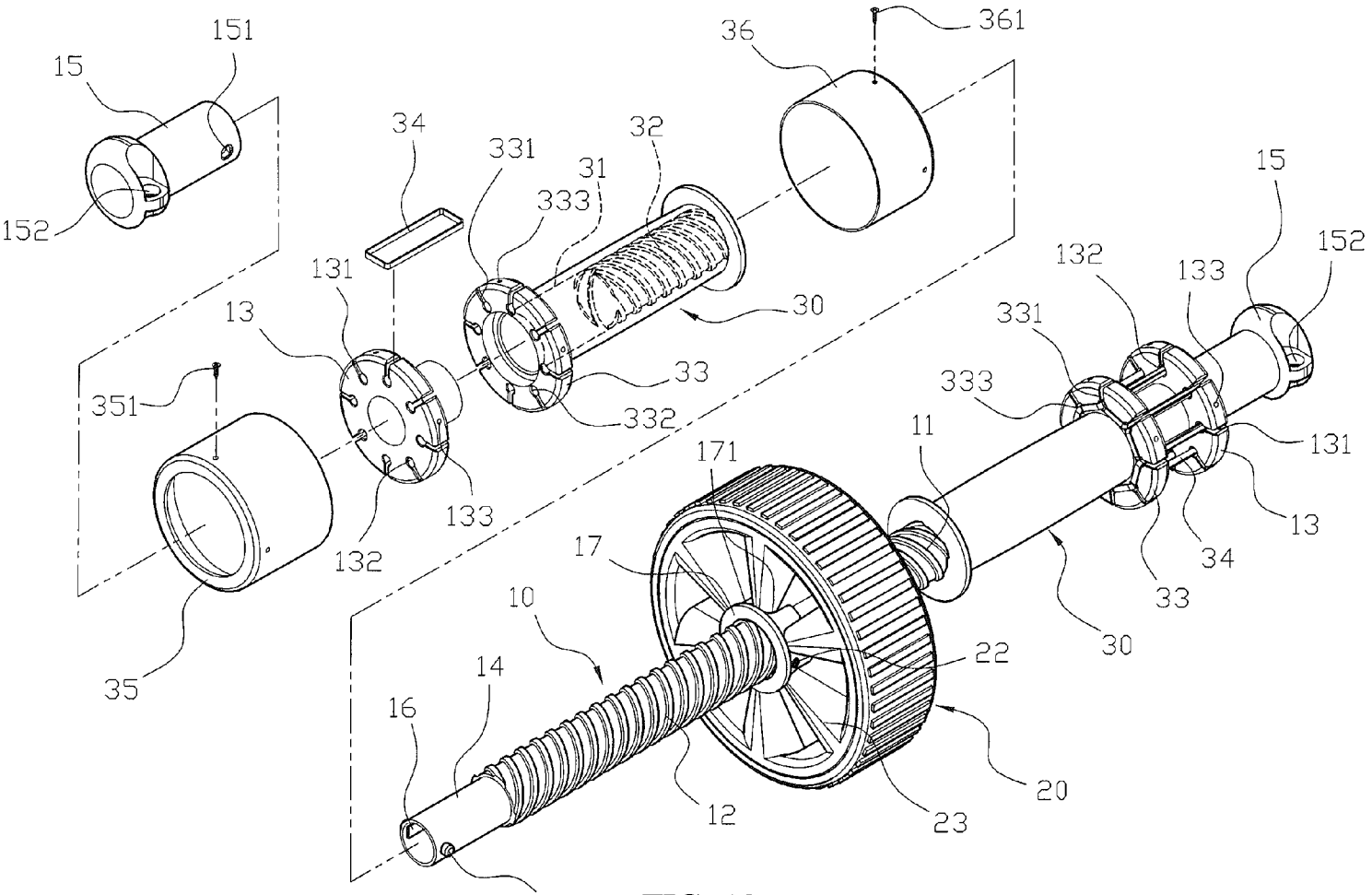
FIG. 13 is an exploded perspective view of a wheel exercising device in accordance with the sixth preferred embodiment of the present invention.
Figure 14:
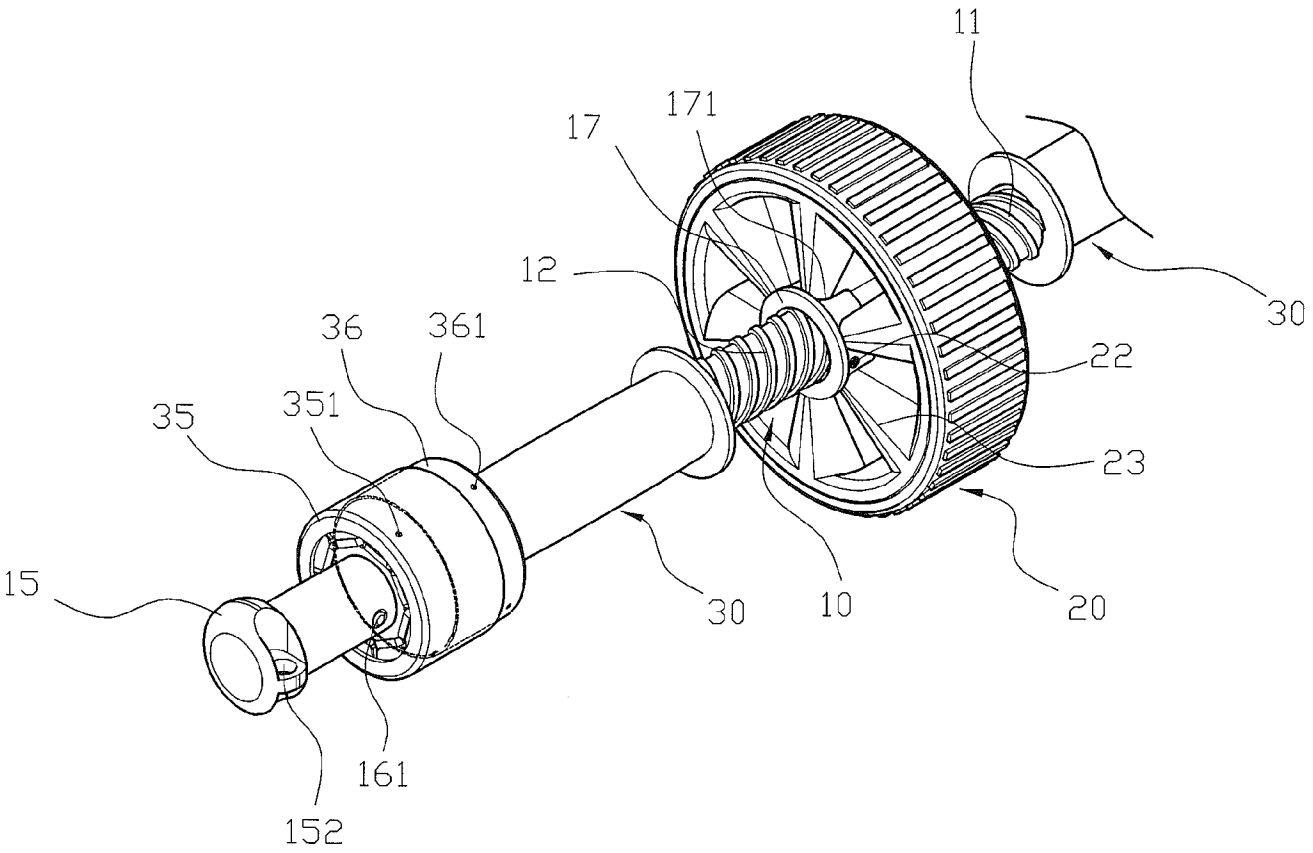
FIG. 14 is a partially perspective assembly view of the wheel exercising device as shown in FIG. 13.
Figure 15:
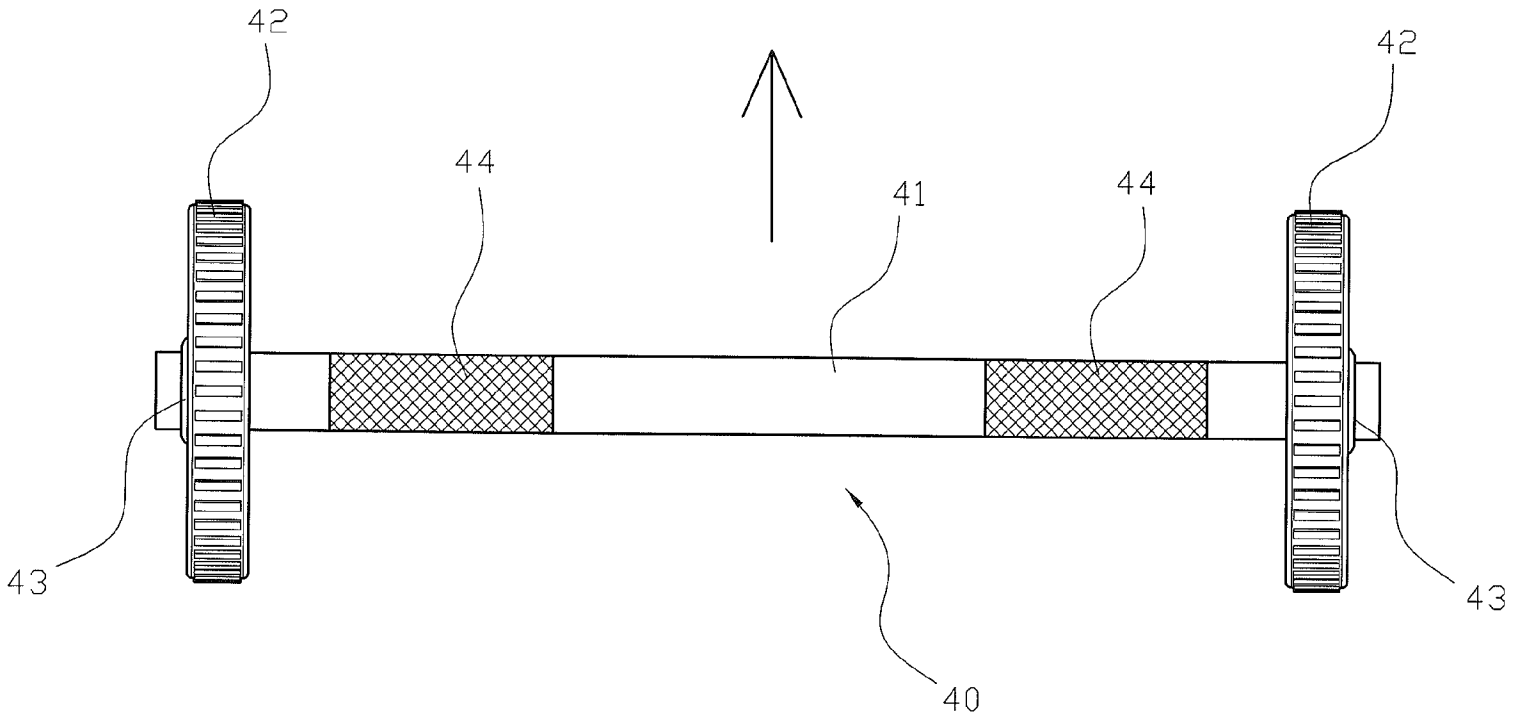
FIG. 15 PRIOR ART
FIG. 15 is a schematic operational view of a conventional wheel exercising device in accordance with the prior art.

Referring to FIGS. 13 and 14, each of the two mounting rings 13 has a periphery formed with a plurality of first locking holes 133, and the connecting ring 33 of each of the two handgrips 30 has a periphery formed with a plurality of second locking holes 333. The wheel exercising device further comprises two first covers 35 each covering the at least one elastic member 34 and each locked on one of the two mounting rings 13 by a plurality of first screw members 351 which are screwed into the first locking holes 133 of one of the two mounting rings 13, and two second covers 36 each covering the at least one elastic member 34 and each locked on the connecting ring 33 of one of the two handgrips 30 by a plurality of second screw members 361 which are screwed into the locking holes 333 of the connecting ring 33 of one of the two handgrips 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A wheel exercising device comprising:

a shank;

at least one wheel mounted on the shank;

two handgrips mounted on the shank;

two mounting rings mounted on the shank; and two caps mounted on the shank and resting on and limiting the two mounting rings respectively;

wherein:

the shank has a surface formed with a first threaded section and a second threaded section having opposite screwing directions;

the shank is provided with a shaft portion located between the first threaded section and the second threaded section;

the shank has two ends each provided with a connecting portion;

each of the two mounting rings is mounted on the respective connecting portion of the shank;

each of the two caps is mounted on the respective connecting portion of the shank;

the at least one wheel has a center provided with a shaft hole secured on the shaft portion of the shank;

each of the two handgrips is formed with a through hole, and the through holes of the two handgrips are mounted on the first threaded section and the second threaded section of the shank;

the through hole of each of the two handgrips has a peripheral wall formed with an internal threaded section, and the internal threaded sections of the two handgrips are screwed onto the first threaded section and the second threaded section of the shank;

each of the two handgrips is formed with a connecting ring directed toward one of the two caps, and at least one elastic member is connected between the connecting ring of each of the two handgrips and each of the two mounting rings; and when the at least one wheel is rotated forward and backward, the two handgrips are moved inward and outward synchronously along the first threaded section and the second threaded section of the shank, and the at least one elastic member provides a pulling force between the connecting ring of each of the two handgrips and each of the two mounting rings, to pull the two handgrips toward the two mounting rings respectively.

2. The wheel exercising device of claim 1, wherein each of the two caps is provided with two apertures, and the respective connecting portion of the shank has an interior provided with a substantially U-shaped elastic plate which has two ends each provided with a boss which protrudes from the respective connecting portion and is inserted into each of the two apertures to form a quick release structure between each of the two caps and the shank.

3. The wheel exercising device of claim 1, wherein the at least one wheel is locked on the shaft portion of the shank by a plurality of bolts.

4. The wheel exercising device of claim 3, wherein:

the at least one wheel is formed with a plurality of spokes extending outward from the shaft hole in a radiating manner;

the wheel exercising device further comprises two limit members mounted on the shank and abutting the at least one wheel;

each of the two limit members is formed with a plurality of retaining grooves directed toward and mounted on the spokes of the at least one wheel; and the bolts extend through each of the two limit members and the at least one wheel and press the shaft portion of the shank, so that the at least one wheel is secured on the shank.

5. The wheel exercising device of claim 1, wherein:

the shaft portion of the shank is divided into two parts, and the wheel exercising device comprises two shanks each having a shaft portion;

the at least one wheel has two ends each formed with two retaining holes connected to the shaft hole; and the shaft portion of each of the two shanks has an interior provided with a substantially U-shaped elastic plate which has two ends each provided with a boss which protrudes from the shaft portion of each of the two shanks and is inserted into each of the two retaining holes of the at least one wheel to form a quick release structure between the at least one wheel and each of the two shanks.

6. The wheel exercising device of claim 1, wherein each of the two caps is provided with a connecting hole and the wheel exercising device further comprises a cushion and two elastic cords each having a first end connected with the connecting hole of each of the two caps and a second end connected with the cushion.

7. The wheel exercising device of claim 1, wherein:

the connecting ring of each of the two handgrips is formed with a plurality of slits arranged in a radiating manner;

each of the slits of each of the two handgrips allows entrance of the at least one elastic member and has a bottom formed with a positioning hole for limiting the at least one elastic member;

each of the two mounting rings is formed with a plurality of slits arranged in a radiating manner; and each of the slits of each of the two mounting rings allows entrance of the at least one elastic member and has a bottom formed with a positioning hole for limiting the at least one elastic member.

8. The wheel exercising device of claim 1, wherein each of the two mounting rings is directly formed with a plurality of positioning holes for fixing the at least one elastic member, and the connecting ring of each of the two handgrips is directly formed with a plurality of positioning holes for fixing the at least one elastic member.

9. The wheel exercising device of claim 7, wherein the at least one elastic member is a rubber elastic loop, a tension spring or an elastic cord.

10. The wheel exercising device of claim 8, wherein the at least one elastic member is a rubber elastic loop, a tension spring or an elastic cord.

11. The wheel exercising device of claim 1, wherein:

each of the two mounting rings has a periphery formed with a plurality of first locking holes;

the connecting ring of each of the two handgrips has a periphery formed with a plurality of second locking holes; and the wheel exercising device further comprises:

two first covers each covering the at least one elastic member and each locked on one of the two mounting rings by a plurality of first screw members which are screwed into the first locking holes of one of the two mounting rings; and two second covers each covering the at least one elastic member and each locked on the connecting ring of one of the two handgrips by a plurality of second screw members which are screwed into the locking holes of the connecting ring of one of the two handgrips.

* * * * *